US009730287B2

(12) United States Patent
Kim et al.

(10) Patent No.: US 9,730,287 B2
(45) Date of Patent: Aug. 8, 2017

(54) LIGHTING APPARATUS AND DIMMING REGULATION CIRCUIT THEREOF

(71) Applicant: SILICON WORKS CO., LTD., Daejeon-si (KR)

(72) Inventors: Yong Geun Kim, Suwon-si (KR); Gyeong Sik Mun, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 0 days.

(21) Appl. No.: 14/747,067

(22) Filed: Jun. 23, 2015

(65) Prior Publication Data

US 2015/0373802 A1 Dec. 24, 2015

(30) Foreign Application Priority Data

Jun. 23, 2014 (KR) ..... 10-2014-0076304

(51) Int. Cl.
*H05B 33/08* (2006.01)

(52) U.S. Cl.
CPC ..... *H05B 33/083* (2013.01); *H05B 33/0815* (2013.01)

(58) Field of Classification Search
CPC H05B 33/08; H05B 33/0812; H05B 33/0815; H05B 33/0845; H05B 33/083; H05B 33/0824; H05B 33/0851; Y02B 20/346; Y02B 20/347; Y02B 20/34
USPC ... 315/185 R, 192, 195, 291, 294, 297, 307, 315/308, 312, 200 R
See application file for complete search history.

(56) References Cited

U.S. PATENT DOCUMENTS

| | | | | |
|---|---|---|---|---|
| 7,081,722 | B1 * | 7/2006 | Huynh | H05B 33/0818 315/185 S |
| 2014/0042918 | A1 * | 2/2014 | Lee | H05B 33/0824 315/185 R |
| 2014/0049174 | A1 * | 2/2014 | Radermacher | H05B 33/0821 315/200 R |
| 2014/0333228 | A1 * | 11/2014 | Angeles | H05B 33/0815 315/291 |

FOREIGN PATENT DOCUMENTS

| | | |
|---|---|---|
| JP | 2012-212649 | 11/2012 |
| KR | 20-0280581 | 7/2002 |
| KR | 0-2005-0061606 | 6/2005 |
| KR | 10-0705452 | 4/2007 |
| KR | 10-2007-0091489 | 9/2007 |
| KR | 10-2011-0104337 | 9/2011 |
| KR | 10-1188236 | 10/2012 |
| KR | 10-1274110 | 6/2013 |
| KR | 10-2014-0053748 | 5/2014 |
| KR | 10-1393746 | 5/2014 |
| KR | 10-2015-0002082 | 1/2015 |

* cited by examiner

*Primary Examiner* — Thai Pham
(74) *Attorney, Agent, or Firm* — Kile Park Reed & Houtteman PLLC

(57) ABSTRACT

The present invention discloses a dimming regulation circuit which stabilizes a rectified voltage in response to an unstable output voltage of a dimmer and a lighting apparatus including the dimming regulation circuit. The dimming regulation circuit stabilizes the rectified voltage and provides the stabilized rectified voltage to a lamp, when a rectified voltage corresponds to a preset stabilization required range.

9 Claims, 11 Drawing Sheets

LIGHTING APPARATUS AND DIMMING REGULATION CIRCUIT THEREOF

BACKGROUND

1. Technical Field

The present disclosure relates to a lighting apparatus capable of improving light flicker, and more particularly, to a dimming regulation circuit which is capable of reducing the occurrence of light flicker by stabilizing a rectified voltage in response to an unstable output voltage of a dimmer, and a lighting apparatus including the same.

2. Related Art

In order to reduce energy, a lighting apparatus is designed to use a light source having high light emission efficiency based on a small amount of energy. Recently, a light emitting diode (LED) has been used as a representative light source of a lighting apparatus. The LED is differentiated from other light sources in terms of various aspects such as energy consumption, lifetime, and light quality.

Since an LED is driven by a current, a lighting apparatus using an LED as a light source requires a large number of additional circuits for current driving.

In order to solve the above-described problem, an AC direct-type lighting apparatus has been developed. The AC direct-type lighting apparatus provides an AC voltage to an LED.

The AC direct-type lighting apparatus is configured to convert an AC voltage into a rectified voltage, and control an LED to emit light through current driving using the rectified voltage. Since the AC direct-type LED lighting apparatus uses a rectified voltage without using an inductor and a capacitor, the AC direct-type LED lighting apparatus has a satisfactory power factor. The rectified voltage indicates a voltage obtained by full-wave rectifying an AC voltage.

The lighting apparatus may include a power supply circuit and a control unit. The power supply circuit provides a rectified voltage using an AC voltage, and the control unit performs current control to drive the light source. In most cases, the control unit may be manufactured as one chip, and mounted in a lighting system.

In the lighting apparatus, the power supply circuit may be configured to have a dimming function. The dimming function may be performed by a dimmer employed in the power supply circuit. The dimmer is configured to determine the position at which the phase of an AC voltage is triggered in response to a change in charge voltage. That is, the dimmer outputs an AC voltage of which the phase is controlled, and the light source emits light at a brightness corresponding to the output voltage of the dimmer.

Through the above-described dimmer, the brightness of the light source of the lighting apparatus can be adjusted in the range from the level at which the light source is turned off to the level at which the light source emits light to the maximum.

In general, the dimmer has a problem in that the compatibility with a load is degraded due to a characteristic difference between internal diode alternating current switches (diac) or triode alternating current switches (triac). Due to the above-described problem, the dimmer has a limitation in providing a high-quality AC waveform.

Specifically, the dimmer may provide an output voltage to which delay is irregularly applied due to an internal RC characteristic. Furthermore, the dimmer may provide an output voltage having a waveform of which the light emission width differs due to the operation characteristic of the triac. Furthermore, the dimmer may provide a positive output voltage and a negative output voltage, which have different magnitudes (amplitude). Furthermore, when noise is introduced from the power source, the output voltage of the dimmer may be distorted.

In particular, when the phase of an output voltage is controlled at a low angle, the dimmer may provide an unstable output voltage. More specifically, when the position at which the dimmer triggers the phase is unstable, the output voltage of the dimmer may include a waveform with an unstable magnitude.

The above-described dimmer may be used in an AC direct-type lighting apparatus. In this case, a rectified voltage provided for light emission is influenced by an output voltage of the dimmer, the output voltage including a waveform of which the magnitude is unspecified. As a result, the AC direct-type lighting apparatus may irregularly emit light, thereby making a light flicker.

Therefore, the AC direct-type lighting apparatus needs to stabilize the rectified voltage which is influenced by the output voltage of the dimmer, in order to reduce light flicker.

SUMMARY

Various embodiments are directed to an AC direct-type lighting apparatus capable of reducing light flicker by stabilizing a rectified voltage which is influenced by an output voltage of a dimmer, and a dimming regulation circuit thereof.

Also, various embodiments are directed to a lighting apparatus capable of stabilizing a rectified voltage in response to an output voltage of a dimmer, which has a low-angle phase, and a dimming regulation circuit thereof.

Also, various embodiments are directed to a lighting apparatus capable of stabilizing a rectified voltage in response to an unstable output voltage of a dimmer and providing a stabilized rectified voltage to a lamp, thereby reducing the occurrence of light flicker, and a dimming regulation circuit thereof.

In an embodiment, a dimming regulation circuit of a lighting apparatus may include: a path control circuit configured to perform control according to whether a first rectified voltage corresponds to a preset stabilization required range; a first transmission circuit configured to provide a second rectified voltage obtained by stabilizing the first rectified voltage to a lamp including an LED, when the first rectified voltage corresponds to the stabilization required range according to control of the path control circuit; and a second transmission circuit configured to refer to the second rectified voltage provided by the first transmission circuit, and provide the second rectified voltage obtained by bypassing the first rectified voltage to the lamp complementarily with the first transmission circuit.

In another embodiment, a dimming regulation circuit of a lighting apparatus may include: a path control circuit configured to perform control according to whether a first rectified voltage corresponds to a preset stabilization required range; a first transmission circuit configured to provide a second rectified voltage obtained by bypassing the first rectified voltage to a lamp including an LED, when the first rectified voltage does not correspond to the stabilization required range according to control of the path control circuit; and a second transmission circuit configured to refer to the second rectified voltage provided by the first transmission circuit and provide the second rectified voltage obtained by stabilizing the first rectified voltage to the lamp complementarily with the first transmission circuit.

In another embodiment, there is provided a lighting apparatus which performs lighting using a lamp including an LED. The lighting apparatus may include: a power supply circuit configured to provide a first rectified voltage of which the phase is controlled; and a dimming regulation circuit configured to provide a second rectified voltage obtained by stabilizing the first rectified voltage to the lamp, when the first rectified voltage corresponds to a preset stabilization required range.

In another embodiment, a dimming regulation circuit may include: a path control circuit configured to perform control according to whether a rectified voltage having a controlled phase corresponds to a preset stabilization required range; and a transmission circuit configured to selectively stabilize the rectified voltage which is determined to correspond to the stabilization required range, according to control of the path control circuit.

DETAILED DESCRIPTION

Figure 1:
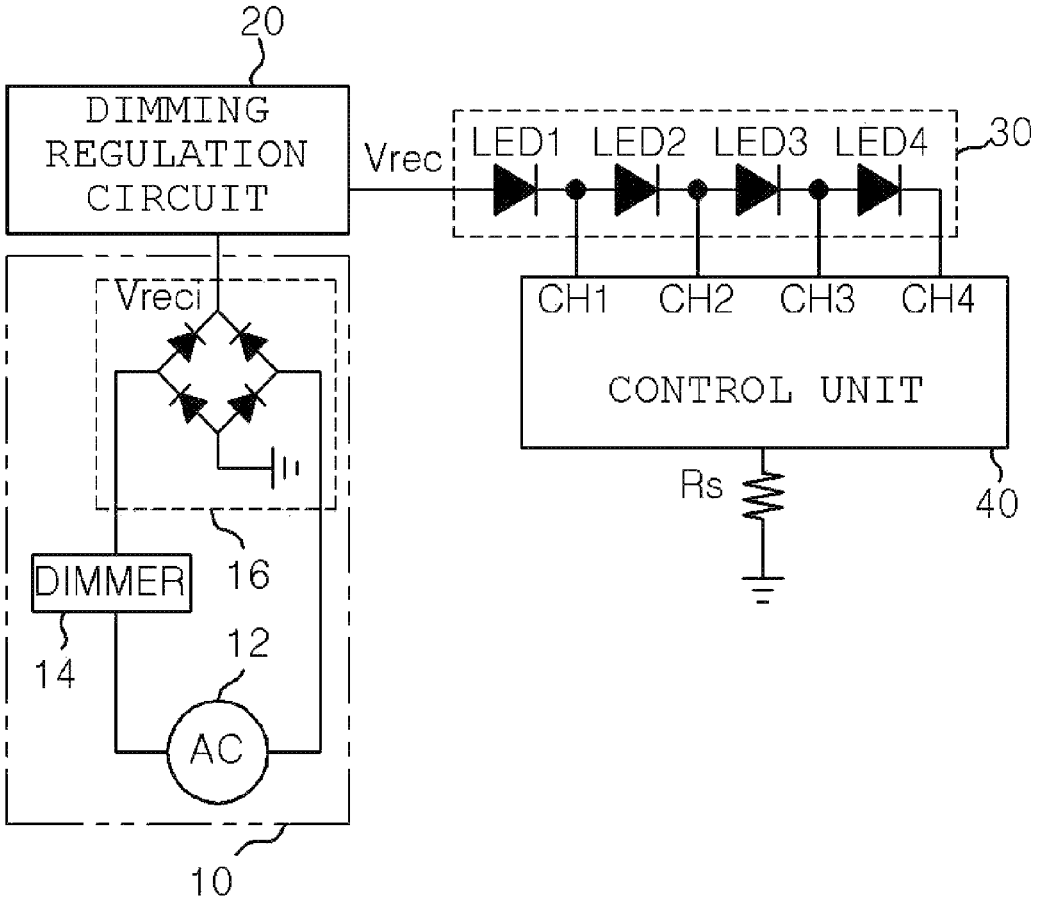
FIG. 1 is a block diagram illustrating a lighting apparatus in accordance with an embodiment of the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

FIG. 1 is a block diagram illustrating a lighting apparatus in accordance with an embodiment of the present invention. Referring to FIG. 1, the lighting apparatus in accordance with the embodiment of the present invention may include a power supply circuit 10, a dimming regulation circuit 20, a lamp 30, and a control circuit.

The power supply circuit 10 may be configured to provide a rectified voltage Vreci to the dimming regulation circuit 20. For this operation, the power supply circuit 10 may include an AC power source 12, a dimmer 14, and a rectifier 16. The rectified voltage outputted from the power supply circuit 10 is represented by Vreci, and a rectified voltage outputted from the dimming regulation circuit 20 is represented by Vrec.

The AC power source 12 may include a common AC power source, and provide an AC voltage.

The dimmer 14 may perform a dimming function of controlling the phase of the AC voltage provided from the AC power source 12. The configuration and operation of the dimmer 14 will be described in detail with reference to FIGS. 3 to 15.

The dimmer 14 may be implemented in a leading edge type using a Triac or a trailing edge type using a transistor or MOSFET. The leading edge-type dimmer may form a rising edge at a triggered phase of an AC voltage, and output a waveform after the rising edge. On the other hand, the trailing edge type dimmer may form a falling edge at a triggered phase of an AC voltage, and output a waveform before the falling edge. In the embodiment of the present invention, the leading edge-type dimmer may be used.

The rectifier 16 may full-wave rectify an output voltage of the dimmer 14, and output the rectified voltage Vreci. The rectifier 16 may be configured to have a typical bridge diode structure.

According to the above-described configuration, the power supply circuit 10 may control the phase of the AC voltage of the AC power source 12 through the dimmer 14, and output the rectified voltage Vreci by full-wave rectifying the output voltage of the dimmer 14. The rectified voltage may have a ripple corresponding to a half cycle of the AC voltage. Hereafter, in the embodiment of the present invention, a change of the rectified voltage may be defined to indicate an increase/decrease of the ripple.

The lamp 30 may emit light in response to the rectified voltage Vrec provided by the dimming regulation circuit 20. In the embodiment of the present invention, the lamp 30 may use LEDs. The lamp 30 may include a plurality of LED groups. FIG. 1 illustrates that the lamp 30 includes four LED groups LED1 to LED4. The number of LED groups may be set to various values according to a designer's intention. Furthermore, each of the LED groups LED1 to LED4 may include one LED or a plurality of LEDs connected in series, in parallel, or in serial-parallel to each other.

The control circuit may include a control unit 40 and a sensing resistor Rs, and the control unit 40 may provide a current path for light emission to the lamp 30 which emits light in response to the rectified voltage Vrec.

More specifically, the control unit 40 may be configured to provide a current path corresponding to light emission of the lamp 30 to any one of the LED groups through current regulation. For this operation, the control unit 40 may include terminals CH1 to CH4 connected to output terminals of the respective LED groups LED1 to LED4 included in the lamp 30. Furthermore, the control unit 40 may be connected to the sensing resistor Rs for forming a current path.

The control unit 40 may provide a current path between the terminal CH1 and the sensing resistor Rs when only the LED group LED1 emits light, provide a current path between the terminal CH2 and the sensing resistor Rs when only the LED groups LED1 and LDE2 emit light, provide a current path between the terminal CH3 and the sensing resistor Rs when only the LED groups LED1 to LED3 emit light, and provide a current path between the terminal CH4 and the sensing resistor Rs when all of the LED groups LED1 to LED4 emit light.

The control unit 40 may provide a current path by performing current regulation in response to light emission of the LED groups LED1 to LED4 based on a change of the rectified voltage Vrec. In order to provide a current path, the control unit 40 may use a sensing voltage of the sensing resistor Rs.

First, the control unit 40 may compare a sensing voltage corresponding to a current flowing through the sensing resistor Rs to internal reference voltages provided in response to the respective LED groups LED1 to LED4. Furthermore, the control unit 40 may provide a current path between the sensing resistor Rs and any one of the terminals CH1 to CH4 according to the comparison results between the sensing voltage and the reference voltages.

Figure 2:
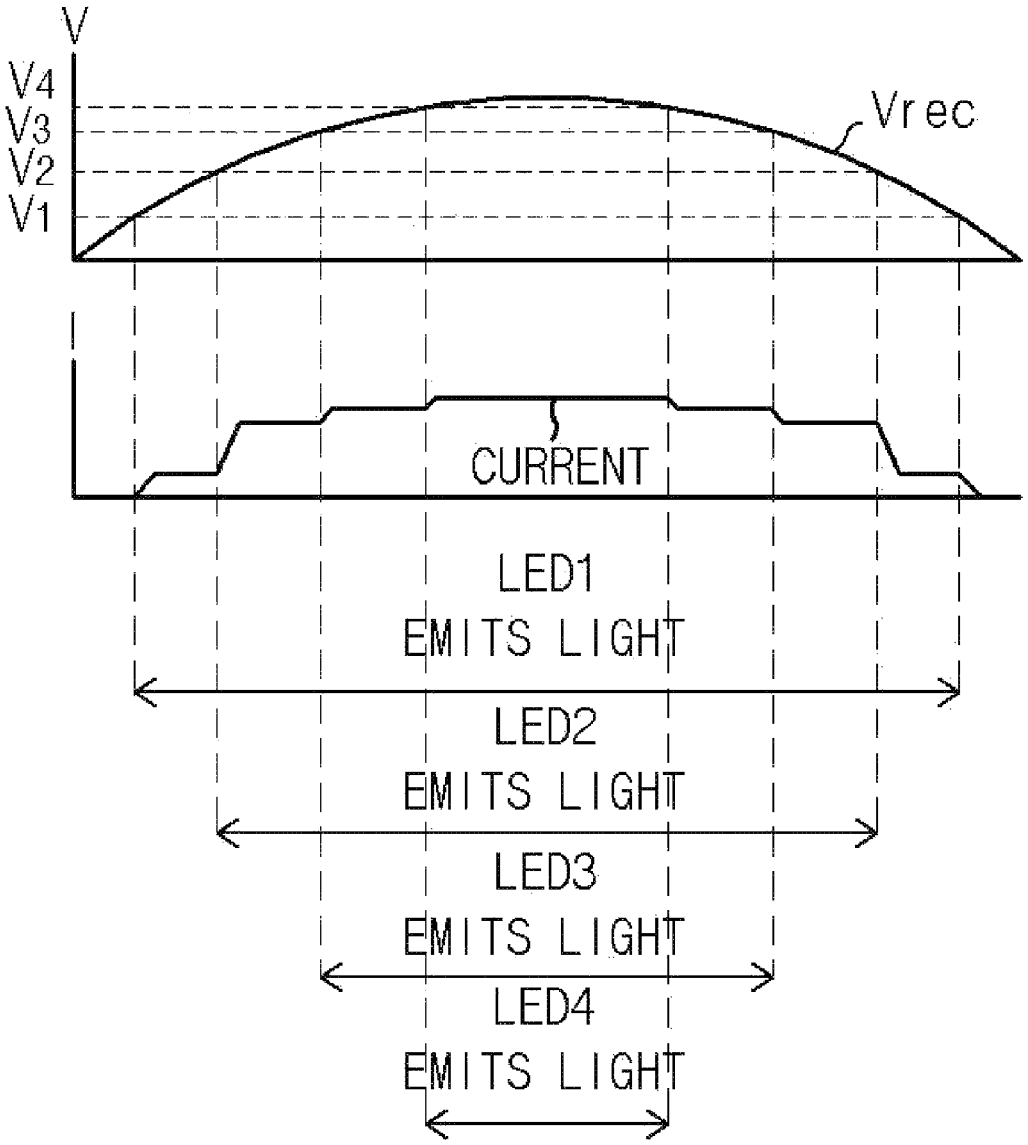
FIG. 2 is a graph illustrating the change of a rectified voltage and the change of current corresponding to light emission in accordance with the embodiment of the present invention.

Referring to FIG. 2, the rectified voltage Vrec provided to the lamp 30 may have a ripple which periodically increases and decreases. In FIG. 2, V1 to V4 represent the light emitting voltages of the LED groups LED1 to LED4. When the rectified voltage Vrec rises over the light emitting voltage V1, the LED group LED1 may emit light. When the rectified voltage Vrec rises over the light emitting voltage V2, the LED groups LED1 and LED2 may emit light. When the rectified voltage Vrec rises over the light emitting voltage V3, the LED groups LED1 to LED3 may emit light. When the rectified voltage Vrec rises over the light emitting voltage V4, the LED groups LED1 to LED4 may emit light.

In response to the sequential light emissions of the LED groups LED1 to LED4, the amount of current on the current path formed by the control unit 40 and the sensing resistor Rs may increase in a stepwise manner, and the change in amount of current flowing through the current path may be sensed as a sensing voltage of the sensing resistor Rs. The current flowing through the sensing resistor Rs may be set to a constant current corresponding to light emission of a specific LED group. Furthermore, the current flowing through the sensing resistor Rs may have a stepped waveform which increases or decreases in a stepwise manner in response to the change in amount of current flowing through the current path.

Through the light emission of the lamp 30 and the current regulation of the control unit 40, the number of LED groups may increase when the rectified voltage Vrec rises, and decrease when the rectified voltage Vrec falls. The control unit 40 may provide a current path which is changed in response to the change of the light emission state.

FIG. 2 illustrates one cycle of a rectified voltage Vrec. When the phase of the rectified voltage Vrec is controlled by the dimmer 14, a waveform after a triggered phase may be provided as the rectified voltage.

Figure 3:
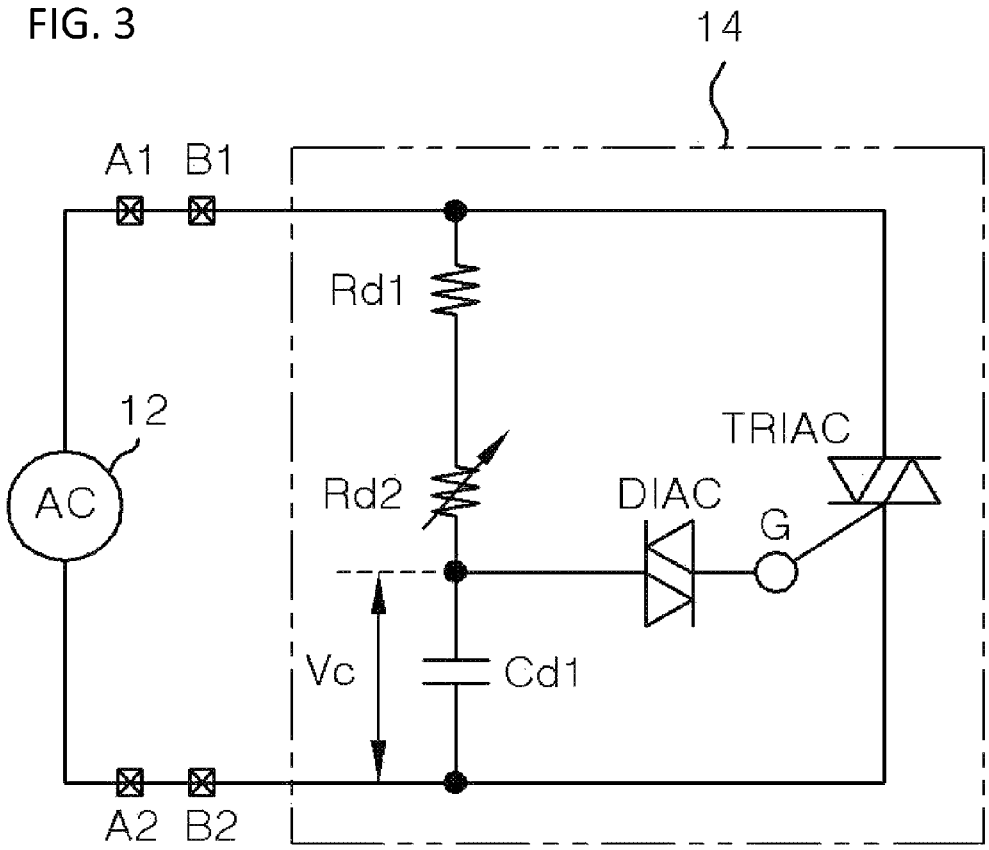
FIG. 3 is a circuit diagram illustrating an example of a dimmer of FIG. 1.

First, the configuration and operation of the dimmer 14 will be described with reference to FIG. 3.

The dimmer 14 may include a resistor Rd1, a variable resistor Rd2, a capacitor Cd1, a diac switch DIAC, and a triac switch TRIAC. The resistor Rd1, the variable resistor Rd2, and the capacitor Cd1 may be connected in series to each other. Furthermore, a node between the variable resistor Rd2 and the capacitor Cd1 may be connected to one side of the diac switch DIAC. The diac switch DIAC may serve to transmit a charge voltage Vc of the capacitor Cd1 to the gate G of the triac switch TRIAC. The turn-on of the triac switch TRIAC may be controlled by the charge voltage Vc provided from the diac switch DIAC.

Figure 4:
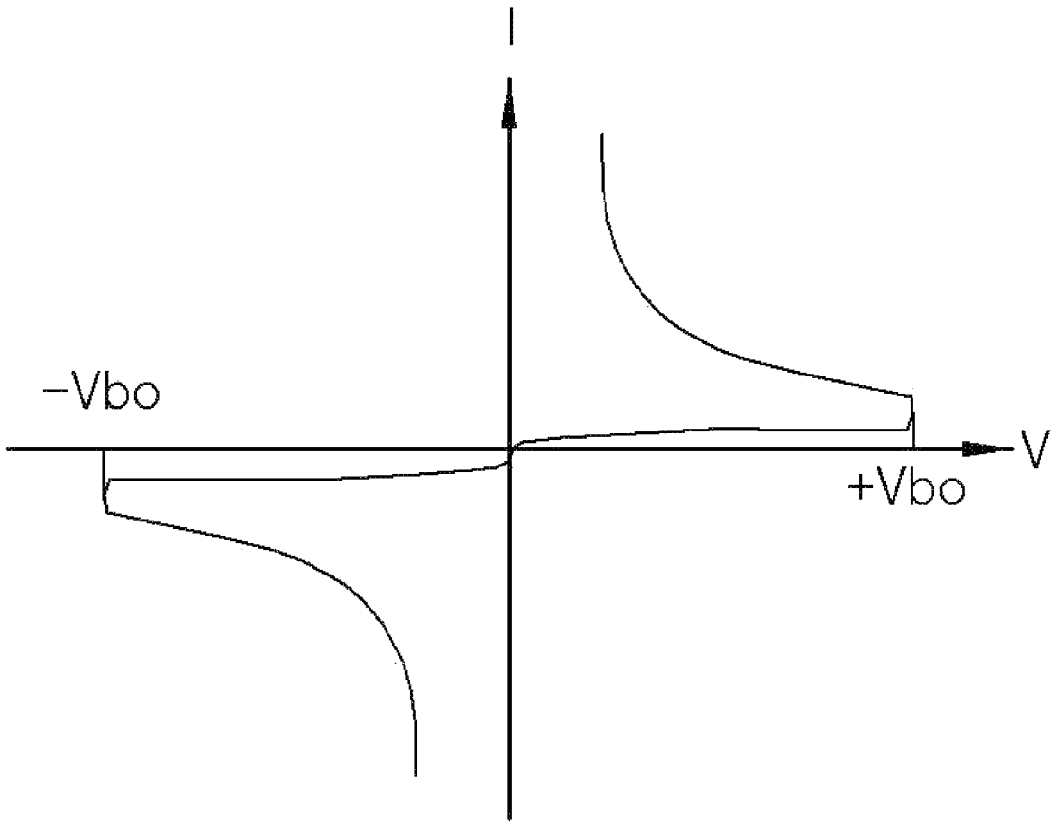
FIG. 4 is a graph illustrating a switching operation characteristic of a diac switch of FIG. 3.

In the dimmer 14, the level of the charge voltage Vc of the capacitor Cd1 may have an influence on the operation of the diac switch DIAC. That is, the diac switch DIAC may an operation characteristic of being turned on in response to a positive charge voltage Vc having a predetermined level or more and a negative charge voltage Vc having a predetermined level or more. The diac switch DIAC may have an operation characteristic of switching a current flow in both directions as illustrated in FIG. 4. When a potential difference is larger than a breakdown voltage +Vbo or −Vbo, the diac switch DIAC may be turned on.

When the diac switch DIAC is turned, the triac switch TRIAC may perform a trigger operation according to the charge voltage Vc.

The time point at which the triac switch TRIAC starts a trigger operation may correspond to the time point at which the phase of the AC voltage is triggered. Thus, the triac switch TRIAC may periodically start a trigger operation whenever the charge voltage Vc reaches the breakdown voltage +Vbo or −Vbo. As a result, the AC voltage may be outputted from the time point at which the phase thereof is partially cut from a sine wave and triggered.

The time point at which the phase of the AC voltage is triggered may be controlled by the variable resistor Rd2. When the value of the variable resistor Rd2 is reduced, the charging speed of the capacitor Cd1 may be increased to advance the trigger operation start point of the triac switch TRIAC, and the magnitude of the AC voltage provided to the lamp 30 may be increased. That is, the waveform of the charge voltage may be shifted from "Vc" to "Vcd" as indicated by an arrow A of FIG. 5. In response to the shifted waveform, the triggered phase of the AC voltage may be controlled in such a manner that the output voltage is increased in the direction of the arrow B.

On the other hand, when the value of the variable resistor Rd2 is increased, the charging speed of the capacitor Cd1 may be decreased to delay the trigger operation start point of the triac switch TRIAC, and the magnitude of the AC voltage provided to the lamp 30 may be reduced. That is, the waveform of the charge voltage may be shifted in the opposite direction of the arrow A in FIG. 5. In response to the shifted waveform, the triggered phase of the AC voltage may be controlled in the opposite direction of the arrow B.

Figure 5:
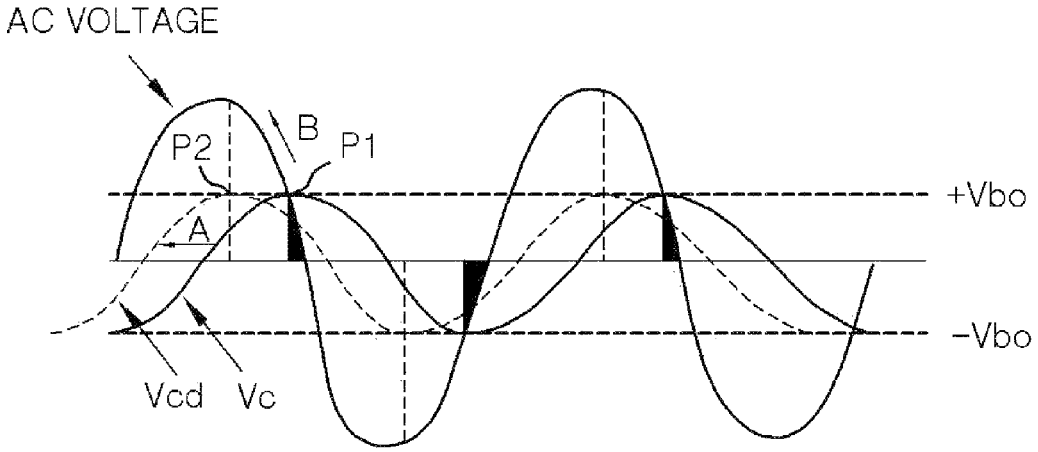
FIG. 5 is a waveform diagram for describing the operation of the dimmer of FIG. 3.

In FIG. 5, P1 represents the time point at which the charge voltage Vc reaches the breakdown voltage +Vbo, and P2 represents the time point at which the charge voltage Vcd with a shifted phase reaches the breakdown voltage +Vbo.

That is, when the resistance value of the variable resistor Rd2 is adjusted, the trigger operation start point (triggered phase) of the triac switch TRIAC can be adjusted. As a result, an output voltage of which the triggered phase is controlled (solid hatching) may be provided to the rectifier 16 from the dimmer 14.

The dimmer 14 may guarantee a current flow after the triggered phase of the triac switch TRIAC. As a result, the phase of the AC voltage may be controlled in a leading edge type. In FIG. 3, A1, B1, A2, and B2 represent terminals which can be connected to a load.

Figure 6A:
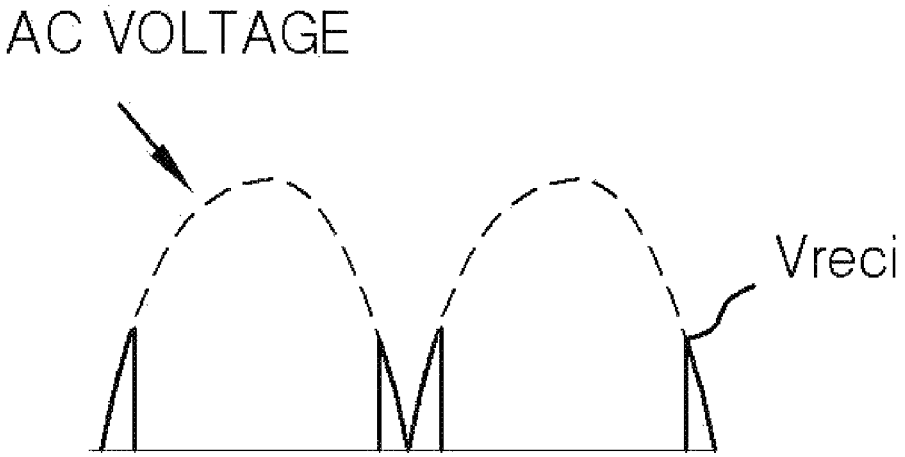
FIG. 6A is a waveform diagram illustrating a low-angle rectified voltage including an unstable waveform.
Figure 6B:
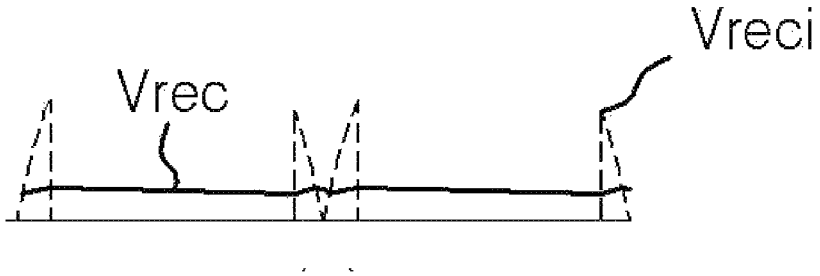
FIG. 6B is a waveform diagram illustrating a stabilized rectified voltage in accordance with the embodiment of FIG. 1.

The rectifier 16 may full-wave rectify the AC voltage of which the triggered phase is controlled and which is provided from the dimmer 14, and output the rectified voltage Vreci. FIG. 6A illustrates a rectified voltage of which the triggered phase is controlled at a full angle, and FIG. 6B illustrates a rectified voltage of which the triggered phase is controlled at a low angle.

As described above, the power supply circuit 10 may provide the rectified voltage Vreci outputted from the rectifier 16 to the dimming regulation circuit 20.

The dimming regulation circuit 20 may provide the rectified voltage Vrec to the lamp 30. When the rectified voltage Vreci provided from the power supply circuit 10 corresponds to a preset stabilization necessary range, the dimming regulation circuit 20 may stabilize the rectified voltage Vreci, and provide the stabilized rectified voltage Vrec to the lamp 30. The configuration and operation of the dimming regulation circuit 20 will be described below.

The rectified voltage Vreci outputted from the power supply circuit 10 may have an unstable output waveform due to the characteristic of the dimmer 14, and the dimming regulation circuit 20 may stabilize the rectified voltage Vreci.

First, the rectified voltage Vreci may be generated on the basis of a half cycle of the AC voltage, and include a waveform corresponding to a positive region and a negative region of the AC voltage. However, the rectified voltage Vreci may have a difference in amplitude between the positive region and the negative region due to the characteristic of the dimmer 14. Therefore, the rectified voltage Vreci may have an unstable output waveform.

Furthermore, the rectified voltage Vreci may be influenced by the value of the variable resistor Rd2. When the variable resistor Rd2 has a large value, the voltage stored in the capacitor Cd1 of the dimmer 14 may be set to such a level to just trigger the diac switch DIAC. Thus, the rectified voltage Vreci may have an unstable output waveform due to the incomplete trigger operation.

Furthermore, the operation characteristic of the dimmer 14 may differ depending on a load. From the viewpoint of the dimmer 14, the lamp 30 and the control unit 40 may serve as loads. Since the lamp 30 including LEDs in accordance with the embedment of the present invention has better efficiency than a conventional incandescent lamp, the lamp 30 may serve as a smaller load than the incandescent lamp, and thus operate at low power. Such a load having low power consumption cannot guarantee a stable output voltage which satisfies a stable operation characteristic at a low angle of the dimmer.

Therefore, the rectified voltage of which the phase is controlled by the dimmer 14 may have an unstable output waveform, and cause light flicker in the LED lamp. The control unit may include various types of control units, such as SMPS (Switching Mode Power Supply), an AC direct type, a constant current driving type, and a current limiting type using a reactance element. In the present embodiment, the control unit 40 may correspond to a constant current driving-type control unit which performs current regulation.

In particular, when the dimmer 14 controls the triggered phase to have a low angle due to a large variable resistance value Rd2, the rectified voltage Vreci provided to the dimming regulation circuit 20 may output an unstable waveform at the initial stage, as illustrated in FIG. 6A. That is, the rectified voltage Vreci may include a waveform having an unnecessary and unspecified magnitude before the triggered phase.

The dimming regulation circuit 20 in accordance with the embodiment of the present invention may set the stabilization necessary range to include a low-angle rectified voltage Vreci equal to or less than a specific level. Therefore, the dimming regulation circuit 20 may stabilize the rectified voltage Vreci when the rectified voltage Vreci is provided at a low angle corresponding to the preset stabilization necessary range. At this time, the stabilization necessary range may be determined according to predetermined determination information. The determination information may include any one of a charge voltage based on the rectified voltage Vreci, the magnitude of the waveform of the rectified voltage Vreci, the pulse width of the rectified voltage Vreci, and the change of a current by the rectified voltage Vreci.

As a result, the dimming regulation circuit 20 in accordance with the embodiment of the present invention may stabilize the rectified voltage Vreci including an unstable voltage at the initial stage as illustrated in FIG. 6A, and provide the stabilized rectified voltage Vrec as illustrated in FIG. 6B. Therefore, the dimming regulation circuit 20 may prevent or suppress light flicker which may occur as light is unnecessarily or irregularly emitted due to the characteristic of the dimmer 14.

Furthermore, the dimming regulation circuit 20 in accordance with the embodiment of the present invention may set the stabilization necessary range to include an unstable rectified voltage Vreci which deviates from a predetermined level due to a pulse or noise. In this case, the dimming regulation circuit 20 may perform a stabilization operation on the unstable rectified voltage Vreci which deviates from the predetermined level due to a pulse or noise.

As described above, the dimming regulation circuit 20 in accordance with the embodiment of the present invention may perform a stabilization operation on a rectified voltage Vreci having a low angle equal to or less than a specific level or an unstable rectified voltage Vreci deviating from a predetermined level.

Figure 7:
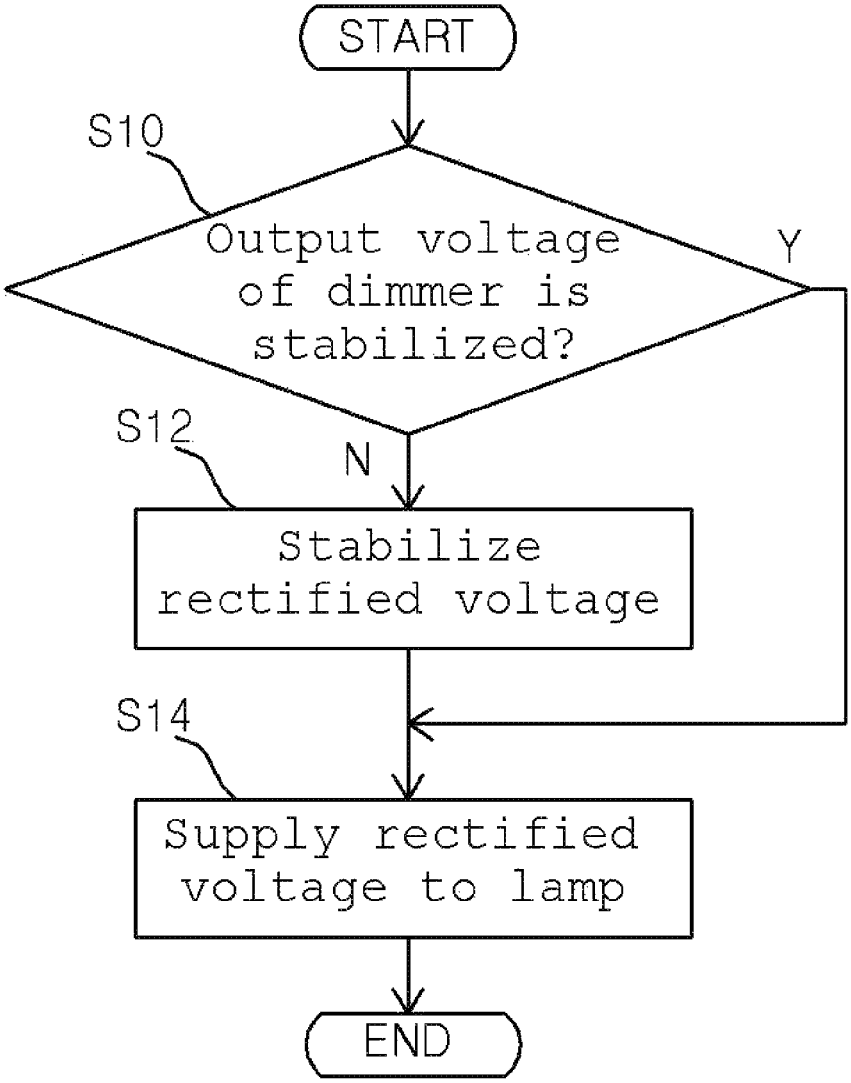
FIG. 7 is a flowchart for describing the operation of the dimming regulation circuit of FIG. 1.

For this operation, the dimming regulation circuit 20 may be operated as illustrated in FIG. 7. First, the dimming regulation circuit 20 may monitor whether an output voltage of the dimmer 14 was stabilized, at step S10. When the output voltage of the dimmer 14 corresponds to the stabilization necessary range, the dimming regulation circuit 20 may stabilize the rectified voltage Vreci at step S12. As a result, the dimming regulation circuit 20 may supply a rectified voltage Vrec obtained by stabilizing the rectified voltage Vreci to the lamp 30 when the rectified voltage Vreci corresponds to the stabilization necessary range, and supply a rectified voltage Vrec obtained by bypassing the rectified voltage Vreci to the lamp 30 when the rectified voltage Vreci does not correspond to the stabilization necessary range, at step S14.

At this time, the stabilization necessary range may be set to include a rectified voltage Vreci having a low angle equal to or less than a specific level or an unstable rectified voltage Vreci deviating from a predetermined level.

Figure 8:
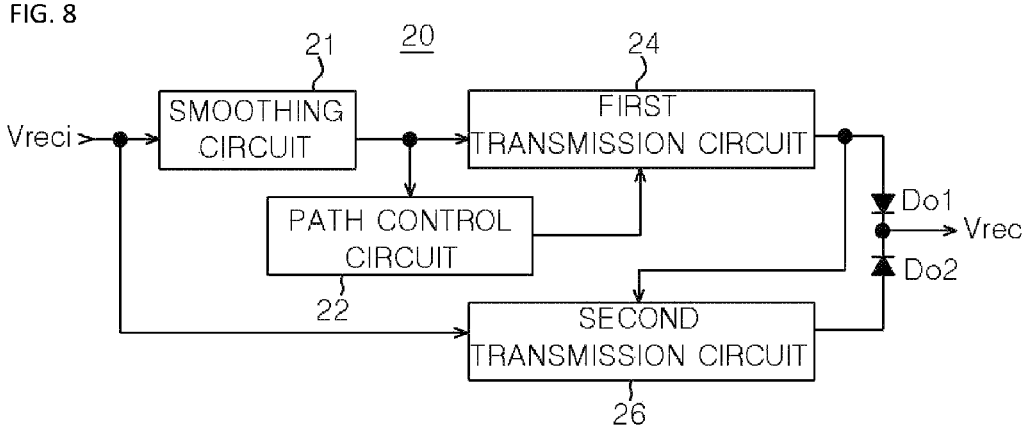
FIG. 8 is a block diagram illustrating the dimming regulation circuit of FIG. 1.

The dimming regulation circuit 20 will be described in more detail with reference to FIG. 8. FIG. 8 illustrates an embodiment which performs a stabilization operation on a rectified voltage Vreci having a low angle equal to or less than a specific level.

The dimming regulation circuit 20 may include a smoothing circuit 21, a path control circuit 22, a first transmission circuit 24, and a second transmission circuit 26, and the rectified voltage Vreci may be provided to the smoothing circuit 21 and the second transmission circuit 26. Hereafter, a rectified voltage inputted from the power supply circuit 10 or a rectified voltage processed in the dimming regulation circuit 20 will be represented by Vreci, and a rectified voltage outputted from the first and second transmission circuits 24 and 26 will be represented by Vrec because the rectified voltage can be determined to be an output of the dimming regulation circuit 20.

The smoothing circuit 21 may perform a smoothing operation for removing a pulse or noise contained in the rectified voltage Vreci, and may include a capacitor.

The path control circuit 22 may be configured to provide determination information to the first transmission circuit 24, the determination information corresponding to the state of the rectified voltage Vreci having passed through the smoothing circuit 21. The first transmission circuit 24 may be configured to stabilize the rectified voltage Vreci and provide the stabilized rectified voltage Vrec to the lamp 30, when the determination information corresponds to the preset stabilization necessary range. The second transmission circuit 26 may be configured to provide the rectified voltage Vrec to the lamp 30 complementarily with the first transmission circuit 24 by referring to the rectified voltage Vrec provided by the first transmission circuit 24. The first and second transmission circuits 24 and 26 may be configured to provide the rectified voltage Vrec to the lamp 30 through diodes Do1 and Do2, respectively.

The path control circuit 22 may be configured to provide determination information to the first transmission circuit 24, the determination information corresponding to any one of a charge voltage based on the rectified voltage Vreci, the amplitude of the waveform of the rectified voltage Vreci, the pulse width of the rectified voltage Vreci, and the change in current by the rectified voltage Vreci. For example, the path control circuit 22 may be configured to provide determination information corresponding to a charge voltage using a capacitor. In another embodiment, the path control circuit 22 may include a peak voltage detector for detecting the amplitude of the waveform of the rectified voltage Vreci, include a timer for determining the pulse width of the rectified voltage Vreci, or include a current-voltage converter for determining the change in current by the rectified voltage Vreci.

As a result, when a rectified voltage Vreci having a low angle equal to or less than a specific level is provided, the first transmission circuit 24 may stabilize the rectified voltage Vreci and output the stabilized rectified voltage Vrec. The first transmission circuit 24 may include a circuit having a capacitor, in order to perform stabilization for reducing a ripple of the rectified voltage Vreci. When a rectified voltage Vreci having an angle exceeding the preset specific level is provided, the first transmission circuit 24 may stop outputting the rectified voltage Vrec.

When the first transmission circuit 24 stops outputting the rectified voltage Vrec, the second transmission circuit 26 may output the rectified voltage Vrec obtained by bypassing the rectified voltage Vreci.

As described above, the operation of the first transmission circuit 24 to provide the rectified voltage Vrec may be controlled by the determination information of the path control circuit 22, and the operation of the second transmission circuit 26 to provide the rectified voltage Vrec may be controlled by the rectified voltage Vrec outputted from the first transmission circuit 24. That is, the first and second transmission circuits 24 and 26 may be configured to complementarily output the rectified voltage Vrec.

Figure 9:
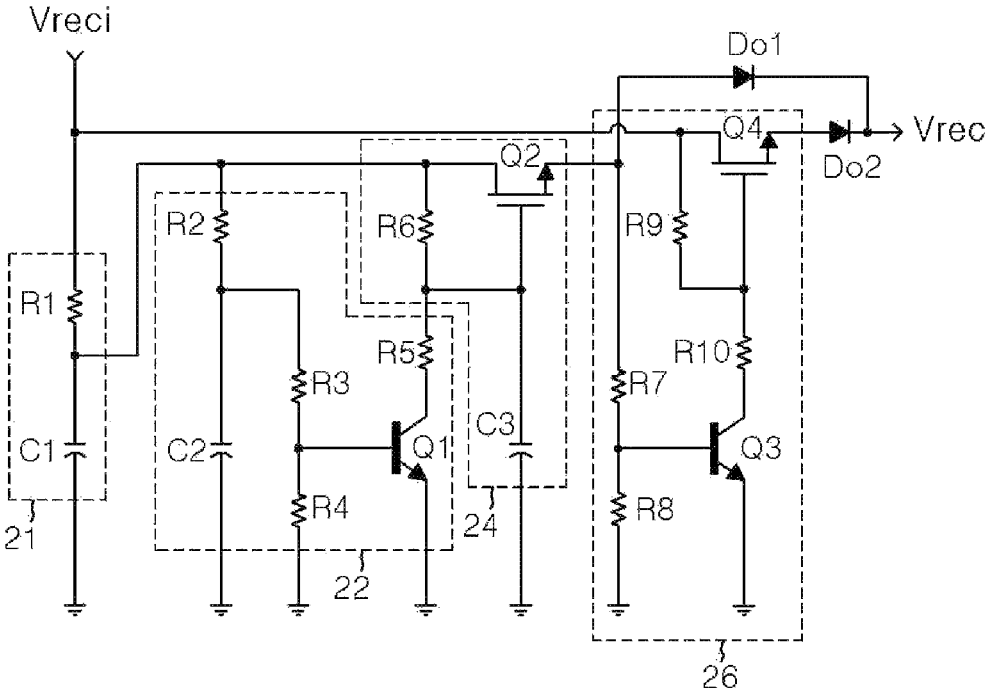
FIG. 9 is a detailed circuit diagram illustrating an example of the dimming regulation circuit of FIG. 8.

FIG. 9 is a detailed circuit diagram of the dimming regulation circuit 20 illustrated in FIG. 8.

Referring to FIG. 9, the smoothing circuit 21 may include a resistor R1 and a capacitor C1 which are connected in series. The capacitor C1 may have a grounded end. The rectified voltage Vreci may be provided to the smoothing circuit 21, and the capacitor C1 may be charged with the rectified voltage Vreci. The smoothing circuit 21 may remove a pulse or noise contained in the rectified voltage Vreci through a smoothing operation of the capacitor C1.

The path control circuit 22 may include a capacitor C2, resistors R2 to R5, and a switching element. The switching element may include a transistor Q1, and the transistor Q1 may be implemented with an NPN bipolar transistor. The resistor R2 and the capacitor C2 may be connected in series, the resistor R2 may be connected to a node between the resistor R1 and the capacitor C1 of the smoothing circuit 21, and the capacitor C2 may have a grounded end. The resistors R3 and R4 may be connected in series, the resistor R3 may be connected to a node between the resistor R2 and the capacitor C2, and the resistor R4 may have a grounded end. The transistor Q1 may include a base connected to a node between the resistor R3 and the resistor R4, a grounded emitter, and a collector connected to the resistor R5.

The first transmission circuit 24 may include a switching element, a resistor R6, and a capacitor C3. The switching element may include a transistor Q2, and the transistor Q2 may be implemented with an NMOS transistor. The transistor Q2 may include a drain configured to receive the rectified voltage Vreci through the resistor R1 of the smoothing circuit 21 and a gate connected to the ground through the capacitor C3. The node between the gate of the transistor Q2 and the capacitor C3 may be connected to a node between the resistor R5 and the resistor R6. That is, a drain-gate voltage of the transistor Q2 may be applied to the resistor R6. Furthermore, the source of the transistor Q2 may be connected to the diode Do1.

Furthermore, the second transmission circuit 26 may include resistors R7 to R10 and switching elements. The switching elements may include transistors Q3 and Q4. The transistor Q3 may be implemented with an NPN bipolar transistor, and the transistor Q4 may be implemented with an NMOS transistor. The resistors R7 and R8 may be connected in series, the resistor R7 may be connected to the source of the transistor Q2, and the resistor R8 may have a grounded end. The transistor Q3 may include a base connected to a node between the resistor R7 and the resistor R8, a grounded emitter, and a collector connected to the gate of the transistor Q4 through the resistor R10. The resistor R9 may be connected between the drain and gate of the transistor Q4, the rectified voltage Vreci may be applied to the drain of the transistor Q4, and the source of the transistor Q4 may be connected to the diode Do2.

The dimming regulation circuit 20 may be configured as illustrated in FIG. 9. The operation of the dimming regulation circuit 20 will be described in detail with reference to FIG. 9.

A pulse or noise contained in the rectified voltage Vreci outputted from the rectifier 16 may be removed by the capacitor C1 of the smoothing circuit 21. The rectified voltage Vreci may have a low angle or more, for example, a half angle or full angle as a phase-controlled voltage waveform.

The rectified voltage Vreci smoothed through the smoothing circuit 21 may be stored in the capacitor C2 of the path control circuit 22. The capacitor C2 may be designed to have a capacity for determining the phase of the rectified voltage Vreci. That is, when the voltage stored in the capacitor C2 is lower than a predetermined value, it may define that the rectified voltage Vreci has a low angle and corresponds to the preset stabilization necessary range. On the other hand, when the voltage stored in the capacitor C2 is equal to or more than a predetermined voltage value, it may define that the rectified voltage Vreci deviates from the stabilization necessary range.

The voltage stored in the capacitor C2 may be transmitted to the base of the transistor Q1 included in the path control circuit 22. When a voltage lower than a turn-on voltage is applied to the base of the transistor Q1, the transistor Q1 may be turned off. When the transistor Q1 is turned off, the rectified voltage Vreci may serve as a drain-gate voltage of the transistor Q2 included in the first transmission circuit 24. As a result, the transistor Q2 may be turned on.

That is, the drain-gate voltage of the transistor Q2, corresponding to the turn-on/off state of the transistor Q1, may serve as determination information, and the drain-gate voltage of the transistor Q2 may correspond to the voltage stored in the capacitor C2 to determine whether the rectified voltage Vreci corresponds to the stabilization necessary range.

The rectified voltage Vreci stabilized by the capacitor C1 may be smoothed by the transistor Q2, the resistor R6, and the capacitor C3 which are included in the first transmission circuit 24, and converted into a more stable voltage. The first transmission circuit 24 may output the stabilized rectified voltage Vrec through the diode Do1.

That is, the rectified voltage Vreci having a low angle as illustrated in FIG. 6A may be stabilized by the first transmission circuit 24, and the rectified voltage Vrec stabilized as illustrated in FIG. 6B may be outputted from the first transmission circuit 24.

At this time, since the rectified voltage Vrec is applied to the base of the transistor Q3, the transistor Q3 may be turned on. Thus, the transistor Q4 may be turned off. That is, a bypass output of the rectified voltage Vrec through the transistor Q4 may be blocked.

When the triggered phase of the rectified voltage Vreci is controlled to a preset low angle or more by the dimmer 14, a sufficient voltage may be applied to the base of the transistor Q1 of the path control circuit 22 by the voltage stored in the capacitor C2, and the transistor Q1 may be turned on. When the transistor Q1 is turned on, the drain-gate voltage of the transistor Q2 included in the first transmission circuit 24 may be lowered. As a result, the transistor Q2 may be turned on. That is, when the rectified voltage Vreci deviates from the stabilization necessary range, the rectified voltage Vrec may be blocked from being outputted from the transistor Q2 through the diode Do1.

At this time, as a low-level voltage is formed at the base of the transistor Q3, the transistor Q3 may be turned off. Thus, the rectified voltage Vreci may serve as the drain-gate voltage of the transistor Q4 included in the second transmission circuit 26. As a result, the transistor Q4 may be turned on to perform a bypass operation of outputting the rectified voltage Vrec to the diode Do2. That is, the rectified voltage Vreci having a triggered phase deviating from the stabilization necessary range may be bypassed by the second transmission circuit 26. As a result, the rectified voltage Vrec may be outputted from the second transmission circuit 26.

Figure 10:
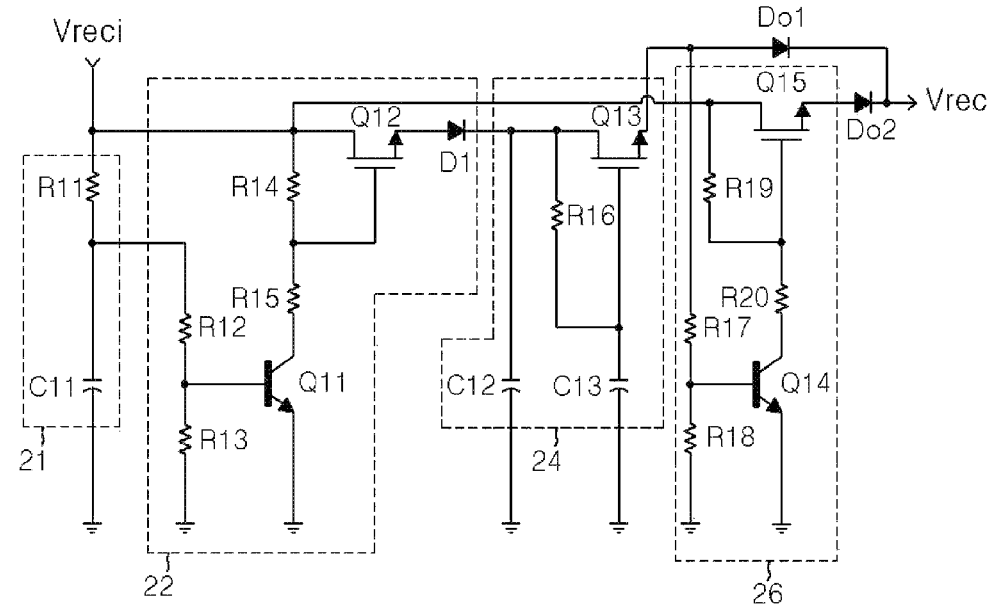
FIG. 10 is a detailed circuit diagram illustrating another example of the dimming regulation circuit of FIG. 8.

FIG. 10 is a detailed circuit diagram illustrating another example of the dimming regulation circuit 20 illustrated in FIG. 8.

Referring to FIG. 10, the smoothing circuit 21 may include a resistor R11 and a capacitor C11 which are connected in series. The capacitor C11 may have a grounded end. The rectified voltage Vreci may be provided to the smoothing circuit 21, and the capacitor C11 may be charged with the rectified voltage Vreci. The smoothing circuit 21 may remove a pulse or noise contained in the rectified voltage Vreci through a smoothing operation of the capacitor C11.

The path control circuit 22 may include resistors R12 to R15 and switching elements. The switching elements may include transistors Q11 and Q12. The transistor Q11 may be implemented with an NPN bipolar transistor, and the transistor Q12 may be implemented with an NMOS transistor. The resistor R12 and the resistor R13 may be connected in series. The resistor R12 may be configured to receive the rectified voltage Vreci through the resistor R11 of the smoothing circuit 21, and the resistor R13 may have a grounded end.

The transistor Q11 may include a base connected to a node between the resistor R12 and the resistor R13, a grounded emitter, and a collector connected to the resistor R14 and the resistor R15 which are connected in series. The resistor R14 may be configured to receive the rectified voltage Vreci. The transistor Q12 may include a gate connected to a node between the resistor R14 and the resistor R15, a drain configured to receive the rectified voltage Vreci, and a source connected to a forward diode D1.

The first transmission circuit 24 may include a resistor R16, a switching element, and capacitors C12 and C13. The switching element may include a transistor Q13, and the transistor Q13 may be implemented with an NMOS transistor. The transistor Q13 may include a source connected to the diode D1 of the path control circuit 22, a gate connected to the ground through the capacitor C13, and a source connected to the diode Do1. The resistor R16 may be connected between the drain and gate of the transistor Q13. Furthermore, the capacitor C12 having a grounded end may be connected in parallel to the resistor R16.

Furthermore, the second transmission circuit 26 may include resistors R17 to R20 and switching elements. The switching elements may include transistors Q14 and Q15. The transistor Q14 may be implemented with an NPN bipolar transistor, and the transistor Q15 may include an NMOS transistor. The resistors R17 and R18 may be connected in series, the resistor R17 may be connected to the source of the transistor Q13, and the resistor R18 may have a grounded end.

The transistor Q14 may include a base connected to a node between the resistor R17 and the resistor R18, a grounded emitter, and a collector connected to the gate of the transistor Q15 through the resistor R20. The resistor R19 may be connected between the drain and gate of the transistor Q15, the rectified voltage Vreci may be applied to the drain of the transistor Q15, and the source of the transistor Q15 may be connected to the diode Do2.

The dimming regulation circuit 20 may be configured as illustrated in FIG. 10. The operation of the dimming regulation circuit 20 will be described in detail with reference to FIG. 10. At this time, the duplicated descriptions of the same function as FIG. 9 are omitted herein.

When the rectified voltage Vreci is provided from the rectifier 16, the voltage stored in the capacitor C11 included in the smoothing circuit 21 may be transmitted to the base of the transistor Q11 included in the path control circuit 22. When an insufficient low voltage is applied to the base of the transistor Q11, the transistor Q11 may be turned off. When the transistor Q11 is turned off, the rectified voltage Vreci may serve as a drain-gate voltage of the transistor Q12. As a result, the transistor Q12 may be turned on. That is, when the rectified voltage Vreci correspond to the stabilization necessary range, the rectified voltage Vreci may be transmitted to the first transmission circuit 24 through the turned-on transistor Q12.

The rectified voltage Vreci stabilized through the capacitor C12 may be transmitted to the transistor Q13 of the first transmission circuit 24, and serve as a drain-gate voltage of the transistor Q13. That is, the transistor Q13 may be turned on to output the rectified voltage Vrec through the diode Do1. That is, the rectified voltage Vreci having a low angle as illustrated in FIG. 6A may be stabilized by the first transmission circuit 24, and the rectified voltage Vrec stabilized as illustrated in FIG. 6B may be outputted from the first transmission circuit 24.

At this time, since the rectified voltage Vrec is applied to the base of the transistor Q14, the transistor Q14 may be turned on. Thus, the transistor Q15 may be turned off. That is, a bypass output of the rectified voltage Vrec through the transistor Q15 may be blocked.

When the triggered phase of the rectified voltage Vreci is controlled to a preset low angle or more by the dimmer 14, a sufficient voltage may be applied to the base of the transistor Q11 by the voltage stored in the capacitor C11 included in the smoothing circuit 23, and the transistor Q11 may be turned on. When the transistor Q11 is turned on, the transistor Q12 may be turned off. When the transistor Q12 is turned off, the transistor Q13 may also be turned off. That is, when the rectified voltage Vreci deviates from the stabilization necessary range, the rectified voltage Vrec may be blocked from being outputted from the transistor Q13 through the diode Do1.

At this time, as a low-level voltage is formed at the base of the transistor Q14, the transistor Q14 may be turned off. Thus, the rectified voltage Vreci may serve as the drain-gate voltage of the transistor Q15 included in the second transmission circuit 26. As a result, the transistor Q15 may be turned on to perform a bypass operation. That is, the rectified voltage Vreci having a triggered phase deviating from the stabilization necessary range may be bypassed by the second transmission circuit 26, and the rectified voltage Vrec may be outputted from the second transmission circuit 26.

The smoothing circuit 21 of FIG. 10 may be included in the path control circuit 22. In this case, a pulse and noise of the rectified voltage by the smoothing circuit 21 can be removed by the capacitor C12 of the first transmission circuit 24, and the capacitor C13 may be designed to perform a stabilization operation of reducing a ripple.

As described above, the dimming regulation circuit 20 in accordance with the embodiment of the present invention may stabilize a rectified voltage having a triggered phase corresponding to the stabilization necessary range, and provide the rectified voltage to the lamp 30. Furthermore, the dimming regulation circuit 20 may bypass a rectified voltage having a triggered phase deviating from the stabilization necessary range, and provide the bypassed rectified voltage to the lamp 30.

Therefore, the lighting apparatus in accordance with the embodiment of the present invention may prevent or suppress light flicker which may occur due to the characteristic of the dimmer 14.

The dimming regulation circuit 20 in accordance with the embodiment of FIGS. 8 to 10 may perform a stabilization operation corresponding to a rectified voltage having a low angle equal to or less than a specific level. FIGS. 8 to 10 illustrate that the dimming regulation circuit 20 includes the smoothing circuit 21. However, depending on a designer's intention, the dimming regulation circuit 20 may have a configuration excluding the smoothing circuit. At this time, the first transmission circuit 24 may include a circuit for removing a pulse or noise contained in the rectified voltage and removing a ripple of the rectified voltage, and perform a stabilization operation.

Furthermore, the dimming regulation circuit 20 in accordance with the embodiment of the present invention may be configured to perform a stabilization operation on an unstable rectified voltage which is not limited to a specific range of angle but deviates from a predetermined level. For this operation, an embodiment of FIG. 11 may be disclosed.

Figure 11:
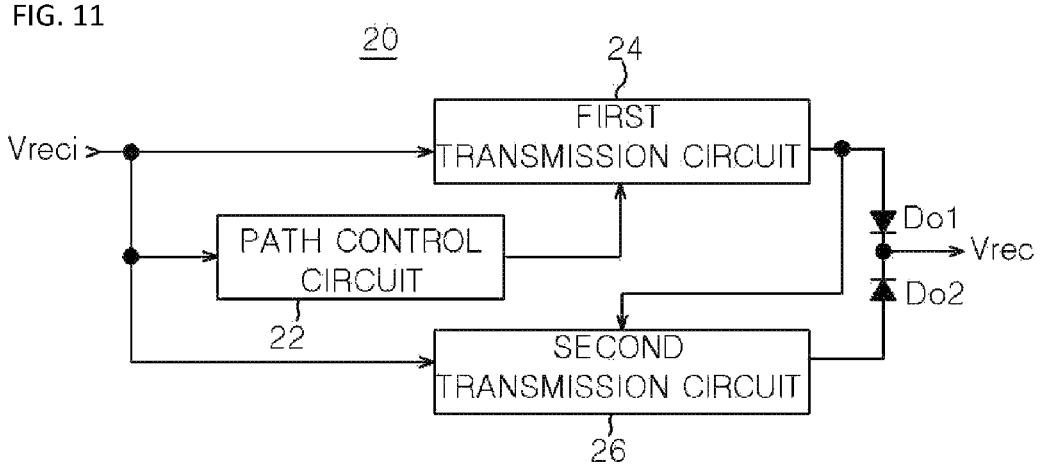
FIG. 11 is a block diagram illustrating another embodiment of the dimming regulation circuit of FIG. 1.

The path control circuit 22 of FIG. 11 may be configured to bypass the rectified voltage Vreci when the rectified voltage Vreci does not correspond to the stabilization necessary range, and control the first transmission circuit 24 to block an output of the rectified voltage Vrec when the rectified voltage Vreci corresponds to the stabilization necessary range. Furthermore, the path control circuit 22 may be configured to distinguish between a rectified voltage in a normal state and a rectified voltage in the stabilization necessary range, using a capacitor, for example.

The first transmission circuit 24 of FIG. 11 may be configured to block an output of the rectified voltage Vrec or output a rectified voltage Vrec obtained by bypassing the rectified voltage Vreci, according to the control of the path control circuit 22. The first transmission circuit 24 of FIG. 11 may perform a switching operation according to control of the path control circuit 22, using a part of the switching elements included in the second transmission circuit of FIGS. 9 and 10.

Furthermore, when an output of the rectified voltage Vrec of the first transmission circuit 24 is blocked, the second transmission circuit 26 of FIG. 11 may output a rectified voltage Vrec obtained by stabilizing the rectified voltage Vreci. The second transmission circuit 26 of FIG. 11 may perform a stabilization operation using a part of the capacitors and the switching elements included in the first transmission circuit of FIGS. 9 and 10, and perform a switching operation in response to an output of the first transmission circuit 24.

In accordance with the embodiments of the present invention, the rectified voltage provided to the control unit and the lamp serving as a load in the AC direct-type lighting apparatus employing the dimmer may be stabilized to reduce the occurrence of light flicker.

Furthermore, an unstable rectified voltage having a phase triggered at a low angle due to the influence of the dimmer can be stabilized to reduce light flicker which may occur in response to an unstable component contained in an output voltage of the dimmer.

While various embodiments have been described above, it will be understood to those skilled in the art that the embodiments described are by way of example only. Accordingly, the disclosure described herein should not be limited based on the described embodiments.

What is claimed is:

1. A dimming regulation circuit of a lighting apparatus, comprising:

a path control circuit configured to comprise a first switching element which is switched depending on any one of a first rectified voltage which deviates from a predetermined level and the first rectified voltage which has a low angle equal to or less than a specific level and provide determination information by the first switching element;

a first transmission circuit configured to comprise a second switching element and provide a second rectified voltage obtained by stabilizing the first rectified voltage to a lamp including an LED through the second switching element which switches to provide the second rectified voltage corresponding to the first rectified voltage according to the determination information in response to the switching state of the first switching element; and a second transmission circuit configured to refer to the second rectified voltage provided from the first transmission circuit, and provide the second rectified voltage obtained by bypassing the first rectified voltage to the lamp complementarily with the first transmission circuit.

2. The dimming regulation circuit of claim 1, wherein the first rectified voltage has a phase controlled by a dimmer.

3. The dimming regulation circuit of claim 1, wherein the determination information corresponds to any one of a charge voltage based on the first rectified voltage, the amplitude of the waveform of the first rectified voltage, the pulse width of the first rectified voltage, and a change in current by the first rectified voltage.

4. The dimming regulation circuit of claim 1, further comprising a smoothing circuit having a capacitor configured to remove a pulse and noise of the first rectified voltage, wherein the smoothing circuit provides the first rectified voltage to the path control circuit and the first transmission circuit.

5. The dimming regulation circuit of claim 1, wherein the first transmission circuit comprises a capacitor for reducing a ripple of the first rectified voltage.

6. The dimming regulation circuit of claim 1, wherein at least one of the path control circuit and the first transmission circuit comprises a capacitor configured to be charged with the first rectified voltage.

7. The dimming regulation circuit of claim 1, wherein the second transmission circuit comprises:

a third switching element configured to be switched in response to the second rectified voltage provided to the lamp by the first transmission circuit; and a fourth switching element configured to selectively provide the second rectified voltage obtained by bypassing the first rectified voltage to the lamp in response to the switching state of the third switching element.

8. A dimming regulation circuit of a lighting apparatus, comprising:

a path control circuit configured to comprise a first switching element which is switched depending on any one of a first rectified voltage which deviates from a predetermined level and the first rectified voltage which has a low angle equal to or less than a specific level and provide determination information by the first switching element;

a first transmission circuit configured to provide a second rectified voltage obtained by bypassing the first rectified voltage to a lamp including an LED, when the first rectified voltage does not correspond to any one of a first rectified voltage which deviates from a predetermined level and the first rectified voltage which has a low angle equal to or less than a specific level according to the determination information of the path control circuit; and a second transmission circuit configured to comprise a second switching element and switch to provide the second rectified voltage obtained by stabilizing the first rectified voltage to the lamp complementarily with the first transmission circuit through the second switching element by referring to the second rectified voltage provided by the first transmission circuit.

9. The dimming regulation circuit of claim 8, wherein the first rectified voltage has a phase controlled by a dimmer.

* * * * *